US005709185A

United States Patent [19]

Aizawa et al.

[11] Patent Number: 5,709,185

[45] Date of Patent: Jan. 20, 1998

[54] LUBRICATING SYSTEM FOR FOUR-STROKE-CYCLE ENGINE

[75] Inventors: Shigemitsu Aizawa; Naohiro Maruyama, both of Matsumoto; Toshio Hirabayashi, Higashichikuma, all of Japan

[73] Assignee: Ishikawajima-Shibaura Machinery Co., Ltd., Tokyo, Japan

[21] Appl. No.: 558,148

[22] Filed: Nov. 15, 1995

[30] Foreign Application Priority Data

Nov. 29, 1994 [JP] Japan ..... 6-294166
Dec. 8, 1994 [JP] Japan ..... 6-304768

[51] Int. Cl.[6] ..... F01M 9/06

[52] U.S. Cl. ..... 123/196 R; 123/196 CP

[58] Field of Search ..... 123/196 R, 196 CP; 184/6.2, 6.7, 6.8, 6.13, 6.11

[56] References Cited

U.S. PATENT DOCUMENTS

| | | | |
|---|---|---|---|
| 2,728,412 | 12/1955 | Bolsius et al. | 123/196 CP |
| 3,554,322 | 1/1971 | Deutschmann | 123/196 CP |
| 4,075,099 | 2/1978 | Pelton et al. | 184/6.13 |
| 4,121,551 | 10/1978 | Turner | 123/196 CP |
| 4,445,592 | 5/1984 | New et al. | 184/6.13 |
| 4,681,189 | 7/1987 | Krisiloff | 184/6.13 |
| 4,794,896 | 1/1989 | Tsai et al. | 184/6.8 |
| 5,454,354 | 10/1995 | Miller | 184/6.13 |
| 5,570,662 | 11/1996 | Niemchick et al. | 123/196 CP |
| 5,582,145 | 12/1996 | Aizawa et al. | 123/196 CP |

FOREIGN PATENT DOCUMENTS

| | | |
|---|---|---|
| 4-93707 | 8/1992 | Japan . |
| 6-346718 | 12/1994 | Japan . |
| 7-34838 | 2/1995 | Japan . |

*Primary Examiner*—Erick R. Solis
*Attorney, Agent, or Firm*—Oblon, Spivak, McClelland, Maier & Neustadt, P.C.

[57] ABSTRACT

Disclosed is a lubricating system for lubricating moving parts in a crank case of a four-stroke-cycle engine. The lubricating system comprises an oil tank for holding oil, an oil passage connected to the oil tank and an engine crank chamber, an oil supply means for supplying fine particles of oil held in the oil tank to the moving parts in the crank chamber via the oil passage, and an oil removing means for removing the fine particles of oil applied to the moving parts in the crank chamber, from the crank chamber without forming oil accumulation. To supply the fine particles of oil to the moving parts in the crank chamber, the oil of a liquid form is thrown to impinge against the moving parts in the crank chamber or is mixed with a gas entering the crank chamber. To remove the oil from the crank chamber without forming oil accumulation, the oil supplied to the moving parts is led up into the combustion chamber through the piston, or is returned into the oil tank with a pressure produced by reciprocation of the piston. The oil led into the crank chamber is in a form of fine particles, and therefore can easily be removed from the crank chamber without forming any oil accumulation.

23 Claims, 17 Drawing Sheets

LUBRICATING SYSTEM FOR FOUR-STROKE-CYCLE ENGINE

BACKGROUND OF THE INVENTION

1. Field of the Invention

The present invention relates to a lubricating system for a four-stroke-cycle engine to be used primarily on a portable work machine.

2. Description of the Prior Art

A portable work machine such as a mower is often used in all positions in which the work machine is tilted in various directions, and therefore is generally mounted with a two-stroke-cycle engine using a mixture of fuel and lubricating oil. Recently, however, investigations have been conducted on the mounting of a four-stroke-cycle engine on portable work machines for the purpose of cleaning engine exhaust gases.

In the four-stroke-cycle engine, the lubricating system includes an oil pan placed beneath a crank case; in this oil pan is formed an oil reservoir. The lubricating system has the oil pan as an essential constituting element regardless of its type such as a dry-sump type, wet-sump type, force-feed type, or splash type. Should the work machine equipped with the four-stroke-cycle engine of a known construction be tilted, oil leakage from the oil pan would occur. The portable work machine, however, is very often tilted largely during operation. It is, therefore, improper to mount, on the portable work machine, the four-stroke-cycle engine provided with the oil pan of the known construction.

In Japanese Utility Model Laid-Open No. Hei 4-93707 a four-stroke-cycle engine adapted to be mounted on a portable work machine has been disclosed. This four-stroke-cycle engine has an oil pan designed to prevent oil leakage when the portable work machine is tilted within a specific range of operation. In a portable work machine mounted with such a four-stroke-cycle engine, the oil is likely to leak from the oil pan when the portable work machine is inclined until the engine is approximately upside-down. It is, therefore, impossible to use the portable work machine in all positions.

SUMMARY OF THE INVENTION

It is an object of the present invention to provide a lubricating system in which no oil leakage will occur even when the engine is tilted.

It is another object of the present invention to provide a lubricating system of simple construction which is able to exactly lubricate each part of the engine.

It is a further object of the present invention to provide a lubricating system which is able to easily treat blowby gas generated in a crank case.

It is a still further object of the present invention to provide a lubricating system which is able to effectively utilize blowby gas generated in a crank case.

The present invention provides the lubricating system for lubricating each part of a four-stroke-cycle engine. This lubricating system comprises an oil tank for holding oil, an oil passage connecting the oil tank with an engine crank case, an oil supply means for supplying fine mists of oil from the oil tank to moving parts in the crank case via the oil passage, and an oil removing means for removing from the crank case the fine mists of oil supplied to the moving parts in the crank case without oil accumulation. The oil supply means comprises at least one of a means for forming fine oil mists by hitting the oil in liquid form against the moving parts in the crank case and a means for forming fine mists of oil by mixing the oil in liquid form with a gas entering the crank case. The oil removing means comprises at least one of a means for leading the oil supplied to the moving parts up into a combustion chamber through a piston of the engine, and a means for returning the oil into the oil tank with a pressure built up by reciprocation of the piston. The oil led into the crank case lubricates in a form of fine mists the moving parts in the crank case. The oil is removed from the crank case by the oil removing means; at this time no oil accumulation is formed in the crank case. Therefore, if a work machine mounted with a four-stroke-cycle engine inclusive of the lubricating system of the present invention is tilted, no oil leakage from the oil pan will occur; that is, the work machine is usable in all positions of operation.

Other features and advantages of the present invention will become apparent from the following description of embodiments of the present invention in reference to the accompanying drawings.

DETAILED DESCRIPTION OF THE PREFERRED EMBODIMENTS

Figure 1:
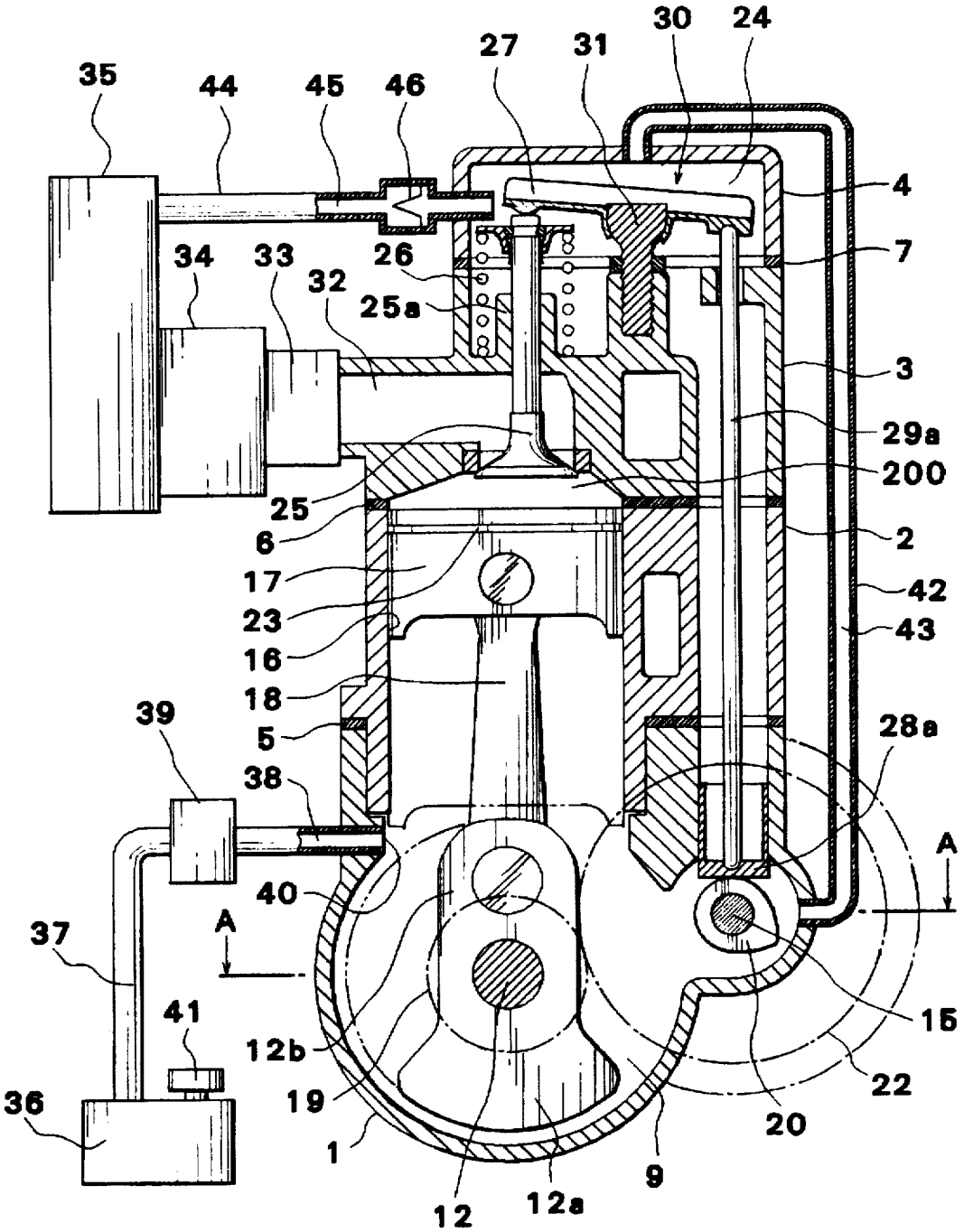
FIG. 1 is a longitudinal sectional front view of a four-stroke-cycle engine in a first embodiment according to the present invention.
Figure 2:
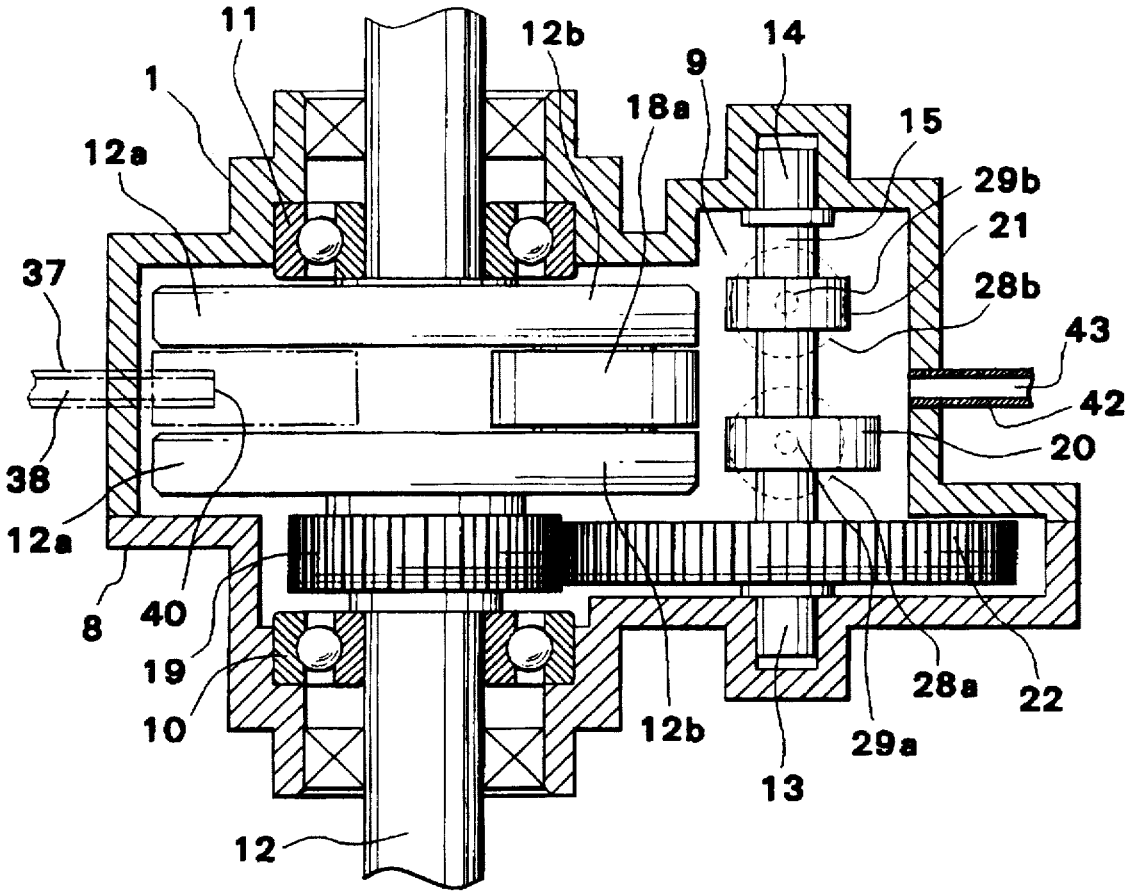
FIG. 2 is a sectional view taken along the line A—A in FIG. 1.

A first embodiment according to the present invention will be explained with reference to FIGS. 1 and 2. FIG. 1 shows the general construction of a four-stroke-cycle engine to be mounted and used on a portable work machine. On the top of a crank case 1, a cylinder block 2 is mounted. On the cylinder block 2 is mounted a cylinder head 3, on which a rocker arm cover 4 is mounted. Between the crank case 1 and the cylinder block 2 is inserted a first gasket 5; between the cylinder block 2 and the cylinder head 3 is inserted a second gasket 6; and between the cylinder head 3 and the rocker arm cover 4 is inserted a third gasket 7. On the side face of the crank case 1, a crank case cover 8 is attached as shown in FIG. 2, and there is formed a crank chamber 9 enclosed with the crank case 1 and the crank case cover 8.

In the crank chamber 9 are rotatably housed a crankshaft 12 which is a moving part supported on bearings 10 and 11 at both end portions, and a camshaft 15 which is supported on bearings 13 and 14 at both end portions. The crankshaft 12 is connected with a piston 17 which moves up and down in the cylinder 16 formed in the cylinder block 2 through a connecting rod 18 which is a moving part, and furthermore with a crank gear 19 which is a moving part. To the camshaft 15, an intake cam 20 and an exhaust cam 21 are fixed, and further, a cam gear 22 in mesh with the crank gear 19 is fixed. On the outer periphery of the piston 17, only a compression ring 23 is mounted as an oil removing means; no oil ring is mounted. That is, the oil removing means serves to raise the engine oil (hereinafter referred to as the "oil") from the crank chamber 9 into a combustion chamber 200 in the cylinder 16 through the piston 17; in this combustion chamber 200, the oil is burned.

The space covered with the rocker arm cover 4 in the upper part of the cylinder head 3 is a valve mechanism housing space 24, in which is housed a valve mechanism 30 which comprises a spring 26 pressing toward such a direction as to close an intake valve 25 and an exhaust valve, not shown, which are mounted in the cylinder head 3, a rocker arm 27 pressing toward such a direction as to open the intake valve 25 and the exhaust valve, and push rods 29*a* and 29*b* which are in contact at one end with the rocker arm 27 and at the other end with the intake cam 20 and the exhaust cam 21 through tappets 28*a* and 28*b*, respectively. The rocker arm 27 is rockingly attached in the upper part of the cylinder head 3 by an adjusting screw 31. The cylinder head 3 is provided with an intake port 32 for feeding an air-fuel mixture to the combustion chamber 200 in the cylinder 16 and an exhaust port, not shown, through which combustion gases in the combustion chamber 200 go out. To the intake port 32 is connected a carburetor 34 through an insulator 33. And to this carburetor 34, an air cleaner 35 is connected.

Next, an explanation will be made on an oil supply means for supplying fine mists of oil to the moving parts in the crank chamber 9 and to the valve mechanism 30. There is provided an oil tank 36 for reserving the oil; this oil tank 36 and the crank chamber 9 are connected by an oil pipe 37, whose interior serves as an oil passage 38. On the way of the oil pipe 37, an oil pump 39 which is an oil supply device is mounted to supply the oil from the oil tank 36 into the crank chamber 9. An opening section 40 of the oil passage 38 which opens in the crank chamber 9 is so formed as to come above either one of such a moving part as the crankshaft 12 and the connecting rod 18 in the crank chamber 9 and the piston 17 in case the four-stroke-cycle engine is tilted in any direction. Therefore, the oil supply means for supplying fine mists of oil to the moving parts in the crank chamber 9 has been designed as a means for forming the fine mists of oil by impinging the oil to the moving parts in the crank chamber 9.

A cap 41 of the oil tank 36 is provided with a check valve, no shown, to prevent a pressure of the oil tank 36 from lowering with a decrease in the amount of the oil in the oil tank 36. The oil tank 36 and a fuel tank, not shown, are so designed and built as to be able to supply the oil and fuel if the four-stroke-cycle engine is turned upside down similarly to the fuel tank of a two-stroke-cycle engine used on conventional portable work machines.

Next, there is provided a pipe 42 for connection between the crank chamber 9 and the valve mechanism housing space 24. The interior of this pipe 42 serves as a blowby gas passage 43 which leads blowby gas from the crank chamber 9 into the valve mechanism housing space 24. The blowby gas passage 43 communicates with the interior of the crank chamber 9 in a position adjacent to the camshaft 15. For connection between the valve mechanism housing space 24 and the air cleaner 35, a pipe 44 is provided. The interior of this pipe 44 serves as a blowby gas return passage 45 for returning the blowby from the valve mechanism housing space 24 into the air cleaner 35. In the blowby gas return passage 45, a check valve 46 is inserted to prevent the back flow of the blowby and air from the air cleaner 35 side into the crank chamber 9.

In the lubricating system of the aforesaid constitution, the oil pump 39 is driven during oil pump operation, thus feeding the oil from the oil tank 36 into the crank chamber 9 via the oil passage 38. The quantity of oil thus supplied is of the order of 10 cc/h in a four-stroke-cycle engine, the displacement of which is 20 to 30 cc. The oil supplied to the crank chamber 9 drops at the opening section 40; since the opening section 40 is so formed as to come above one of the moving parts such as the crankshaft 12, the connecting rod 18, and the piston 17 even when the four-stroke-cycle is inclined in any direction, the oil that has dropped from the opening section 40 hits on the crank weight 12*a* and crank arm 12*b* which are components of the crankshaft 12, on the large end 12*a* of the connecting rod 18, and on the skirt section of the piston 17, being scattered in a form of fine mists. Then, the fine mists of oil thus scattered attach on each of sliding parts and engaging parts in the crank chamber 9, well lubricating these parts.

Subsequently, on the outer periphery of the piston 17 only the compression ring 23 is installed; no oil ring is installed. Therefore most of the oil that has lubricated each part in the crank chamber 9 goes into the combustion chamber 200 through between the inner peripheral surface of the cylinder 16 and the compression ring 23 with the sliding reciprocation of the piston 17, being burned in the combustion chamber 200. No oil accumulation, therefore, will occur in the crank chamber 9 and accordingly no oil recovery apparatus for recovering the oil will be needed. The oil, therefore, will not leak if the engine is largely tilted, allowing the use in all positions of the portable work machine mounted with the four-stroke-cycle engine of the present embodiment.

In the combustion chamber 200, a very small quantity of oil is burned as compared with that in the two-stroke-cycle engine; and exhaust gas and smoke components are approximately the same as those in the four-stroke-cycle engine provided with an oil pan.

Since no oil ring is mounted in the outer periphery of the piston 17, the piston 17 can operate with little sliding resistance. Furthermore, since there is no need for splashing much oil in the oil pan by means of an oil splasher as in the case of the four-stroke-cycle engine with an oil pan, the rotational resistance of the crankshaft 12 is decreased, consequently insuring higher power output of the four-stroke-cycle engine.

Next, the blowby generated in the crank chamber 9 passes through the blowby gas passage 43, being guided into the valve mechanism housing space 24, where the valve mechanism 30 is lubricated with oil separated from the blowby gases. The oil, after lubricating the valve mechanism 30, is consumed by sliding motion between the intake valve 25 and a valve guide 25*a* and between the exhaust valve and the valve guide section. The blowby after oil separation flow through the blowby gas return passage 45 into the air cleaner 35 and, after being mixed with the fuel, is fed for burning to the combustion chamber 200.

The blowby gas passage 43 communicates with the crank chamber 9 at a place close to the camshaft 15, and therefore, the blowby flowing from the crank chamber 9 into the blowby gas passage 43 goes around the camshaft 15. Therefore, the bearing 14 of the camshaft 15 and the sliding surfaces of the cams 20 and 21 fixed on the camshaft 15 and the tappets 28*a* and 28*b* are lubricated well with fine oil mists included in the blowby.

It should be noticed that in the present embodiment, the four-stroke-cycle engine that has been explained has the piston 17 provided with one compression ring 23 on the outer periphery; but the piston may be provided with a plurality of compression rings.

Figure 3:
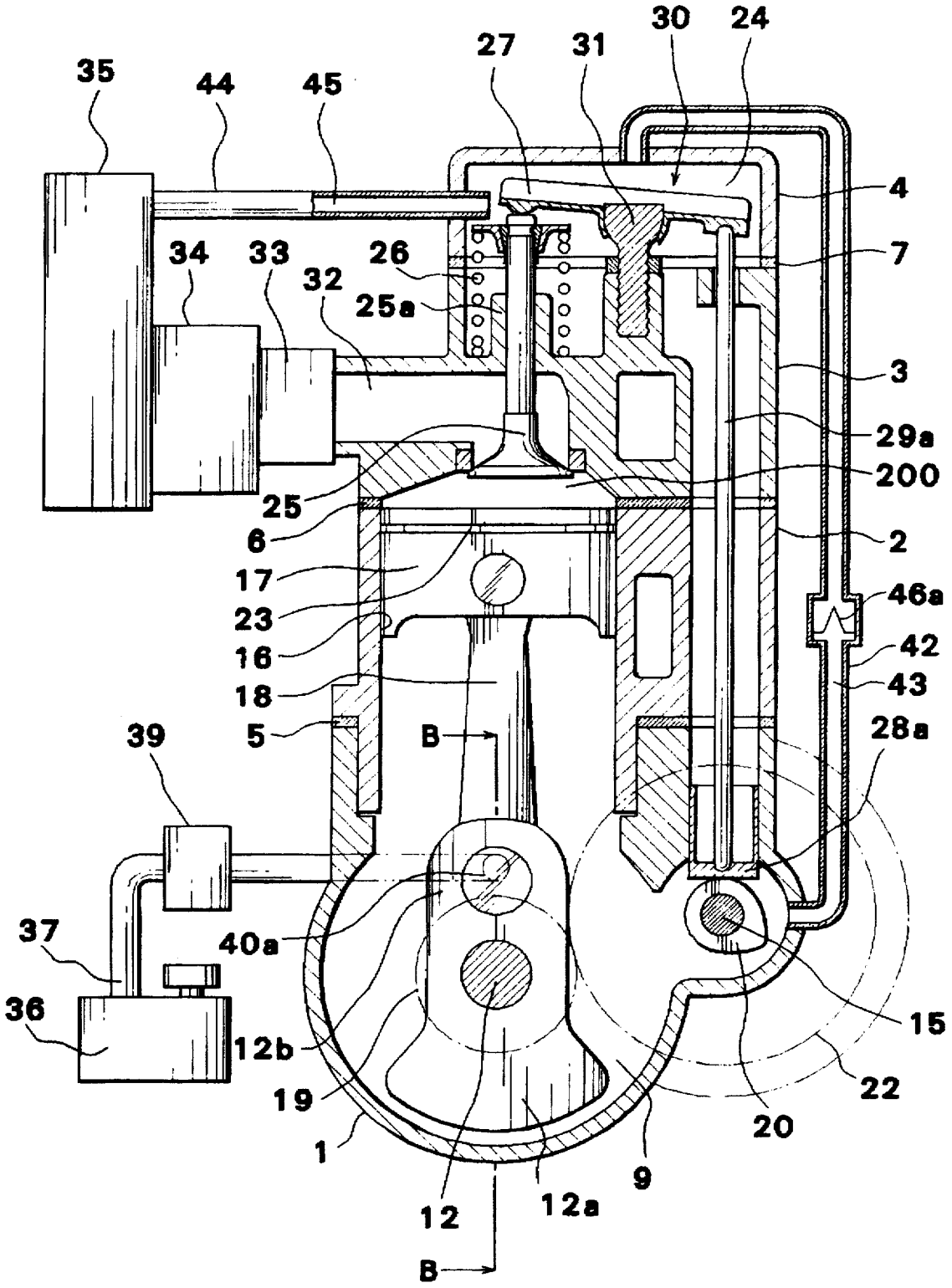
FIG. 3 is a longitudinal sectional front view of the four-stroke-cycle engine in a first modification of the first embodiment.
Figure 4:
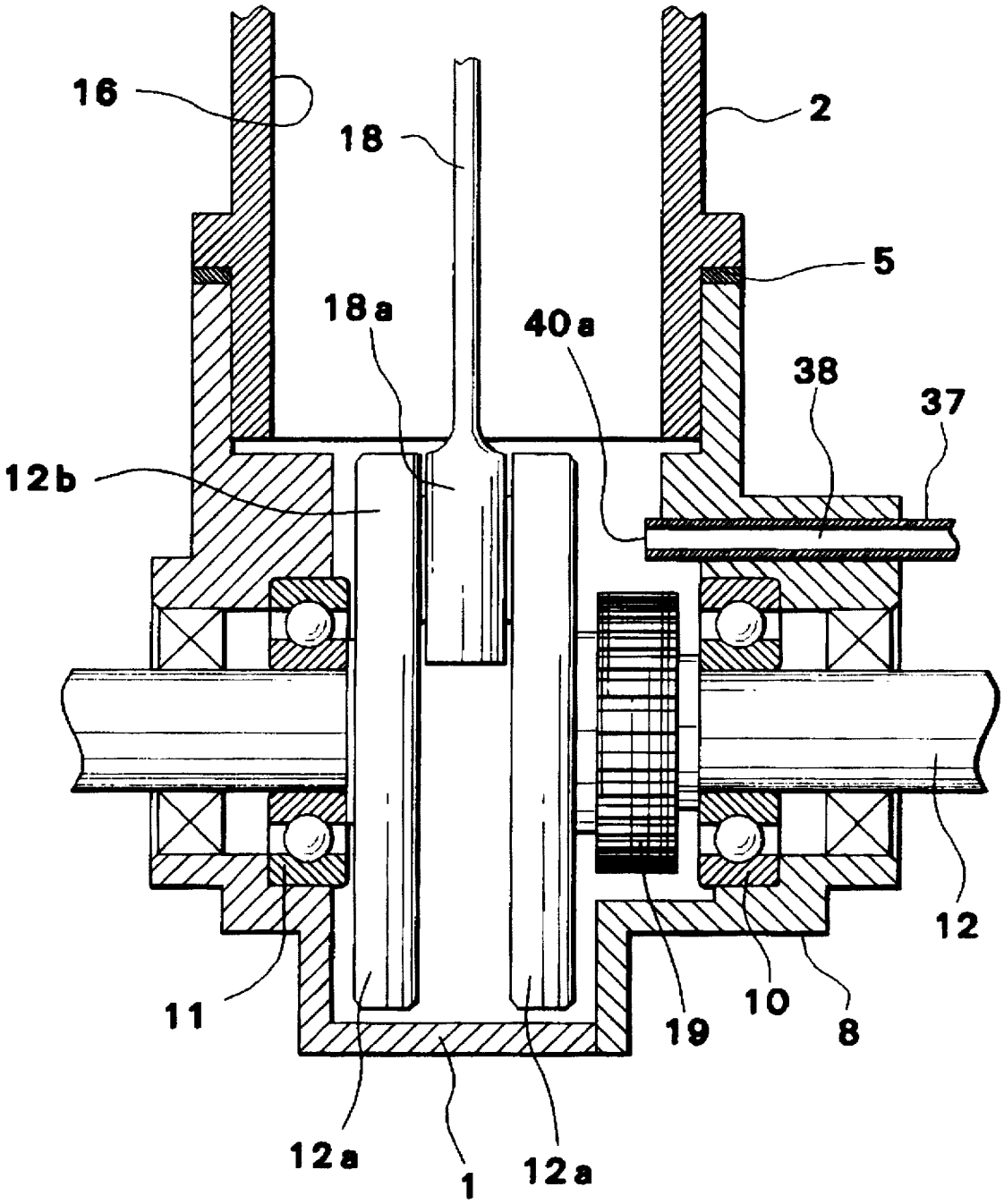
FIG. 4 is a sectional view taken along the line B—B in FIG. 3.

A first modification of the first embodiment according to the present invention will be explained with reference to FIGS. 3 and 4. In this modification, an opening section 40*a* of the coil passage 38 which is open in the crank chamber 9 is formed above the crank gear 19 which is a moving part, when the four-stroke-cycle engine is in a normal erected position. In the blowby gas passage 43 connected to the crank chamber 9 and the valve mechanism housing space 24 is mounted a check valve 46*a* for preventing the back flow of the blowby gases and air from the air cleaner 35 side into the crank chamber 9. The check valve 46*a* has the same function as the check valve 46 installed in the blowby gas return passage 45.

In the four-stroke-cycle engine of the above constitution, the oil to be supplied into the crank chamber 9 falls from the opening section 40*a* in drops, which hit on the rotating crank gear 19, becoming fine particles and scattering. The fine particles of oil thus scattered attach on sliding and engaging parts in the crank chamber 9, thus lubricating parts well. When the four-stroke-cycle engine is tilted upside down, the oil that has dropped from the opening section 40*a* hits on the skirt section of the piston 17, becoming fine particles, which scatter to sufficiently lubricate each moving part in the crank chamber 9.

Figure 5:
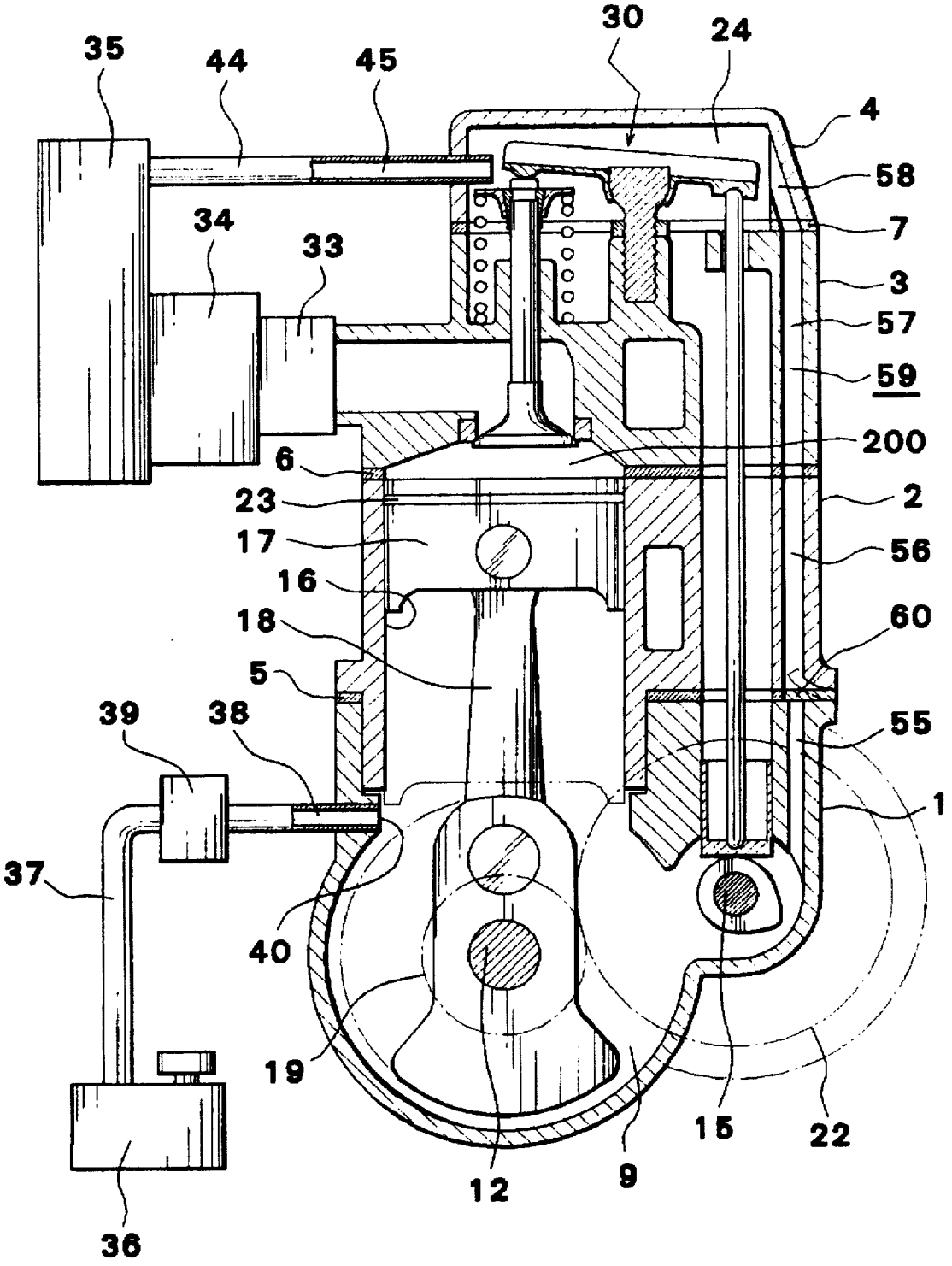
FIG. 5 is a longitudinally sectional front view of the four-stroke-cycle engine in a second modification of the first embodiment.

Next, a second modification concerning the first embodiment according to the present invention will be explained with reference to FIG. 5. In this modification, a first passage 55 is formed in the crank case 1, a second passage 56 is formed in the cylinder block 2, a third passage 57 is formed in the cylinder head 3, and a fourth passage 58 is formed in the rocker arm cover 4, so that a blowby gas passage 59 may be formed by connecting these passages 55 to 58 when the four-stroke-cycle engine is built by assembling the crank case 1, the cylinder block 2, the cylinder head 3 and the rocker arm cover 4.

Furthermore, a valve 60 which allows only the flow of blowby from the crank chamber 9 to the valve mechanism housing space 24 is formed integrally with the first gasket 5 inserted between the crank case 1 and the cylinder block 2.

In the above-described constitution, because the blowby gas passage 59 is formed inside the crank case 1 and the cylinder block 2, the number of parts can be decreased to thereby reduce the cost as compared with the case where the blowby gas passage 43 is formed of the pipe 42 as shown in FIGS. 1, 3, 4 and 5.

Since the valve 60 is formed integrally with the first gasket 5, it is unnecessary to separately mount a valve for checking the back flow of the blowby and air from the air cleaner 35 side into the crank chamber 9, thereby decreasing the number of parts and accordingly lowering the cost.

In the present modification, the valve 60 formed integrally with the first gasket 5 was explained by example; it is to be noticed that the valve may be formed integrally with the second gasket 6 interposed between the cylinder block 2 and the cylinder head 3, or with the third gasket 7 interposed between the cylinder head 3 and the rocker arm cover 4.

In the present modification, the blowby gas passage 59 formed by connecting with four passages 55 to 58 was explained by example; it is to be noticed that the fourth passage 58 formed in the rocker arm cover 4 may be dispensed with, and the blowby gas passage may be formed of three passages 55, 56 and 57 by directly connecting one end of the third passage 57 to the valve mechanism housing space 24.

Figure 6:
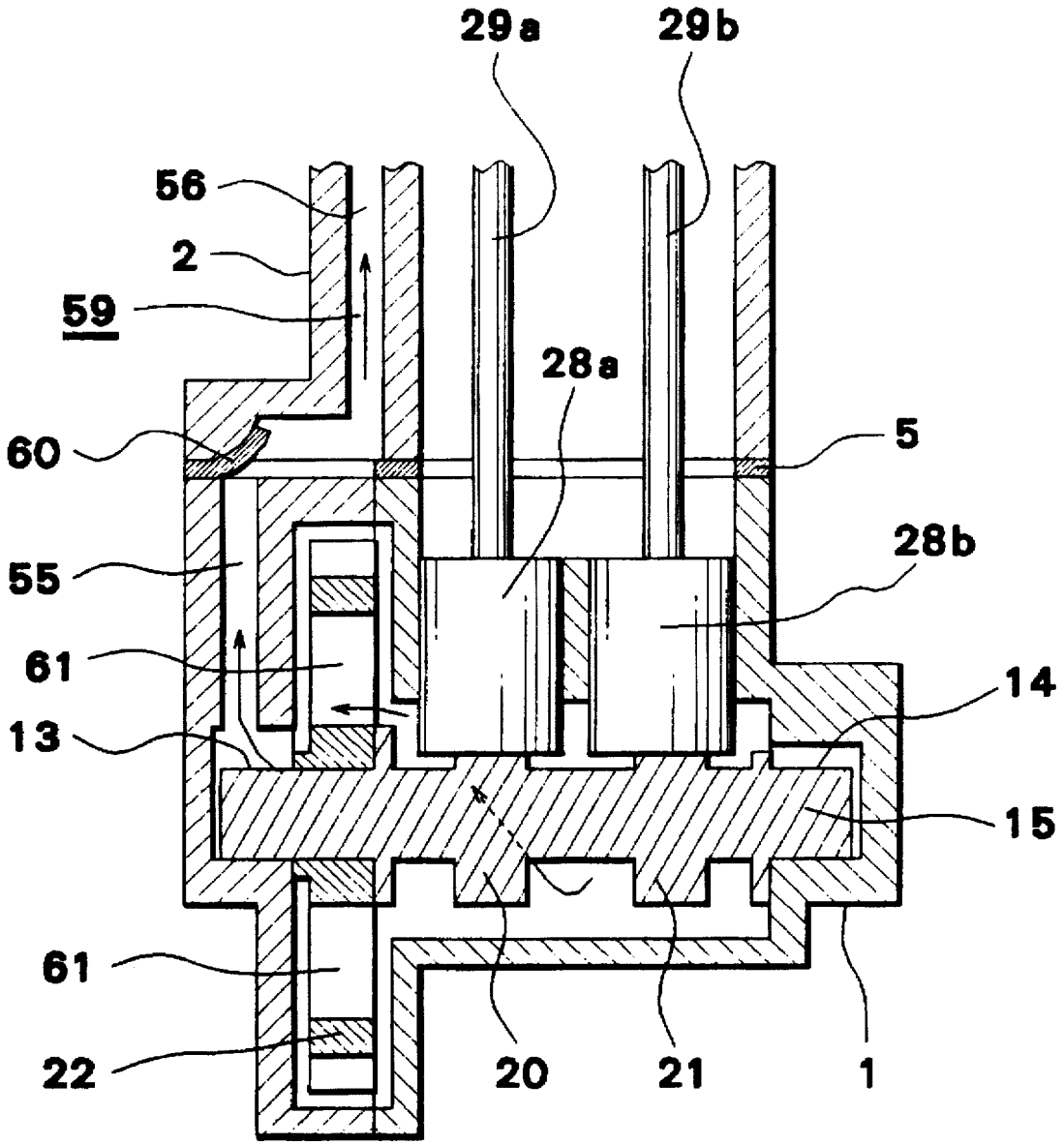
FIG. 6 is a longitudinal sectional side view of the four-stroke-cycle engine in a third modification of the first embodiment.

A third modification concerning the first embodiment according to the present invention will be explained with reference to FIG. 6. In this modification, a through hole 61 through which the blowby gases can pass from one side face of the cam gear 22 to the other side face is formed in the cam gear 22; and further, one end of the blowby gas passage 59 is connected to a space between the inner peripheral surface of the crank chamber 9 and the side face of the cam gear 22. Therefore, the blowby to be led into the valve mechanism housing space 24 flows into the blowby gas passage 59 after passing via the through hole 61 and the narrow space between the side face of the cam gear 22 and the inner peripheral surface of the crank chamber 9, thus well lubricating a bearing 13 located behind the cam gear 11 and accordingly preventing seizure and abrasion.

Figure 7:
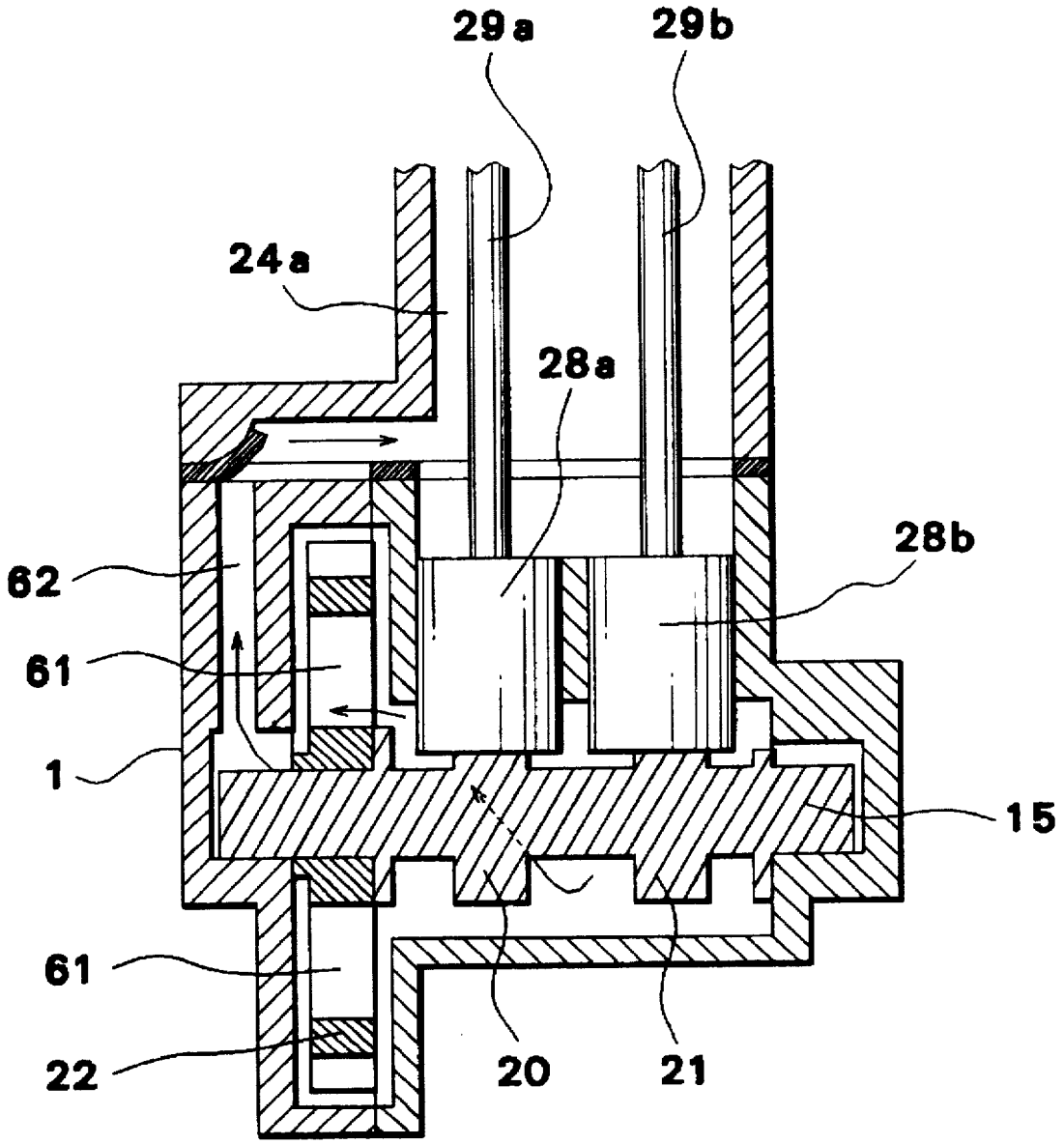
FIG. 7 is a longitudinal sectional side view of the four-stroke-cycle engine in a fourth modification of the first embodiment.

Next a fourth modification concerning the first embodiment according to the present invention will be explained with reference to FIG. 7. In the present modification, the crank chamber 9 and a push rod space 24*a* which is a part of the valve mechanism housing space 24 and in which the push rod 29*a* is inserted are connected through a passage 62 formed in the crank case 1. Therefore, as the push rod space 24*a* functions as the blowby gas passage, it is not needed to form a special blowby gas passage. It, therefore, is possible to design and build a small-sized four-stroke-cycle engine.

Figure 8:
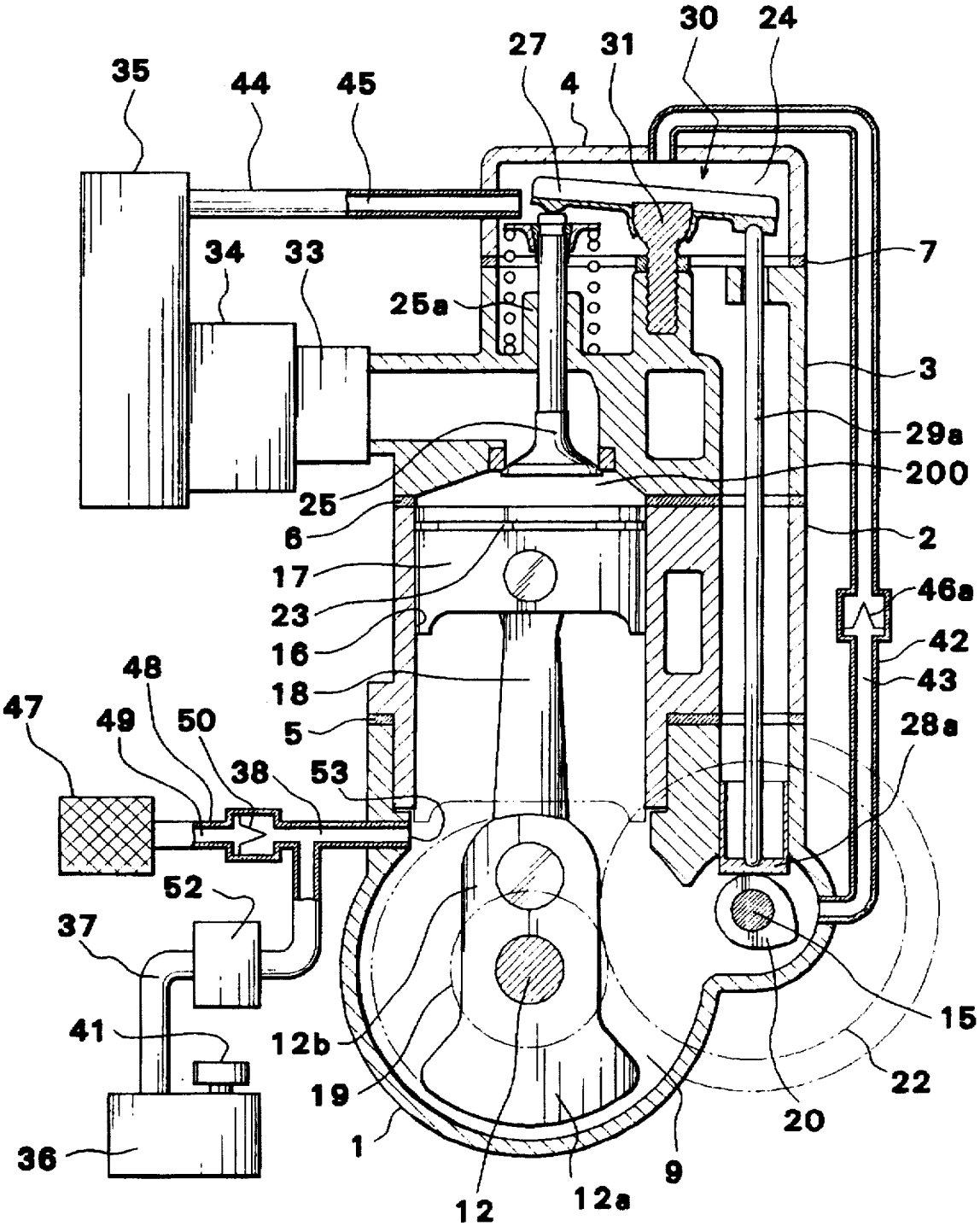
FIG. 8 is a longitudinal sectional front view of the four-stroke-cycle engine in a second embodiment according to the present invention.

A second embodiment according to the present invention will be explained with reference to FIG. 8. Same parts as those in the first embodiment are designed by the same reference numerals and therefore are not explained herein. The present embodiment differs from the first embodiment in the constitution of the oil supply means for supplying fine particles of oil to the moving parts in the crank chamber 9. That is, as the oil supply means there is adopted a means for mixing the oil in a liquid form with the gas flowing in the crank chamber 9 to thereby produce minute particles of oil. More particularly, there is provided a pipe 48 with its one end connected to the crank chamber 9 through the oil pipe 37 and with its other end connected to an air filter 47, and the interior of this pipe 48 serves as a gas passage 49 in which the air which is a gaseous body flows. Therefore the gas passage 49 communicates with the oil passage 38 in the oil pipe 37, and communicates with the crank chamber 9 via this oil passage 38. In the gas passage 49 is inserted a valve 50 which opens and closes with a pressure change in the crank chamber 9, allowing only the flow of air toward the crank chamber 9. An opening section 53 of the oil passage 38 which opens in the crank chamber 9, similarly to the first embodiment, is so formed as to come to a position above either one of the piston and moving parts such as the crankshaft 12 and the connecting rod 18 in whichever direction the four-stroke-cycle engine tilts.

In the four-stroke-cycle engine of the above constitution, the valve 50 in the gas passage 49 opens and closes with the pressure change in the crank chamber 9 caused by the reciprocation of the piston 17. That is, the valve 50 is opened at the timing when, with the rise of the piston 17, a negative pressure is built up in the crank chamber 9, thus allowing the flow of the air into the crank chamber 9 via the gas passage 49. At this time, during the operation of the four-stroke-cycle engine, the oil pump 52 is driven to supply the oil from the oil tank 36 to the passage communicating with the oil passage 38 and the gas passage 49. The oil thus supplied to this passage flows into the crank chamber 9 together with the air flowing into the crank chamber 9. At this time the oil flowing together with the air into the crank chamber 9 is blown with the air, thereby becoming fine particles. The oil that has entered the crank chamber 9 hits on the crank weight 12*a*, the crank arm 12*b*, the connecting rod 18, and the skirt of the piston 17, scattering in a form of finer particles to properly lubricate each part in the crank chamber 9.

Figure 9:
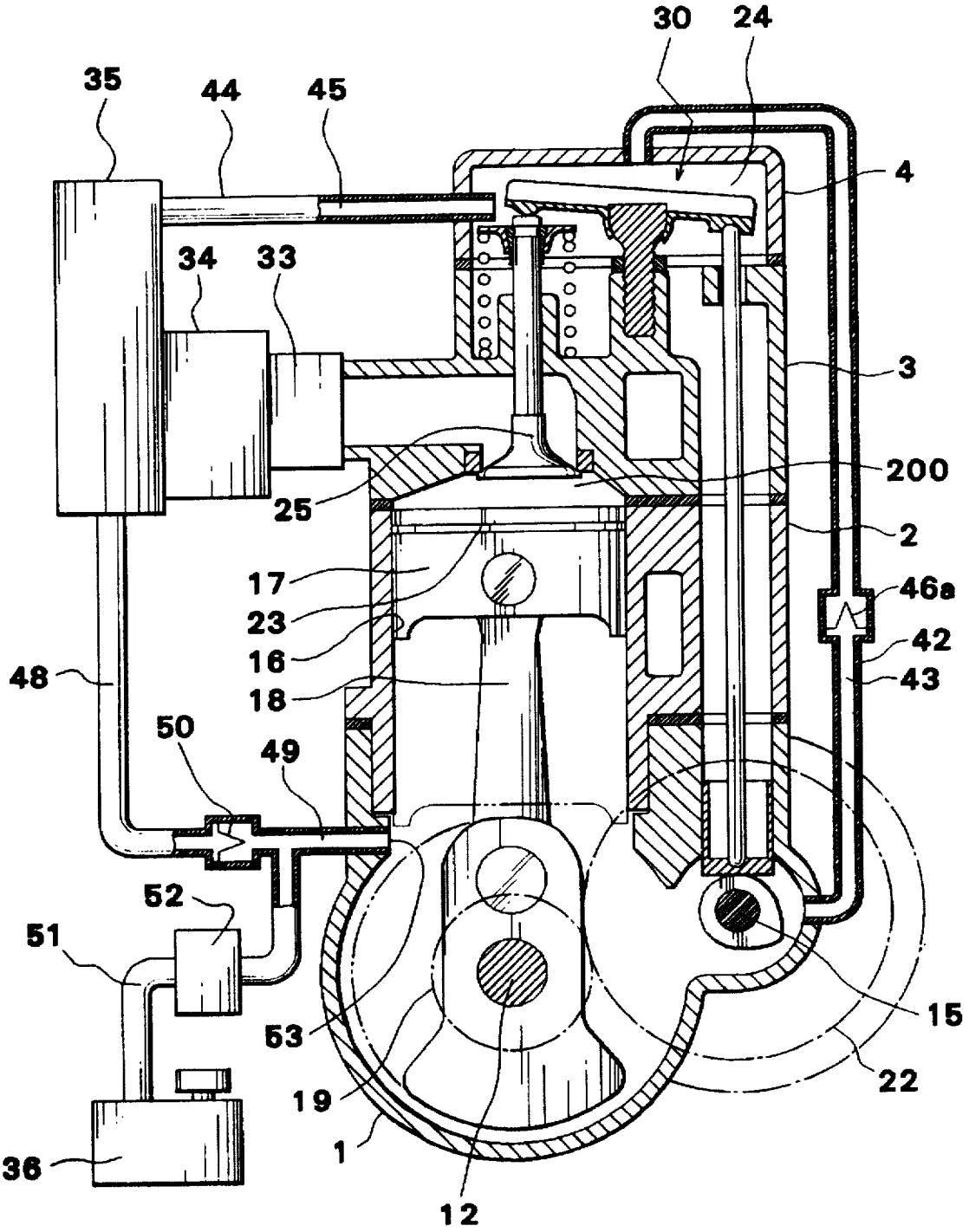
FIG. 9 is a longitudinal sectional front view of the four-stroke-cycle engine in a first modification of the second embodiment.

A first modification concerning the second embodiment according to the present invention will be explained with reference to FIG. 9. In the present modification, the other end of the pipe 48 explained in FIG. 9 is connected to the air cleaner 35 which is in connection with the carburetor 34. The air cleaned at the air cleaner 35 enters the crank chamber 9, and therefore, no special filter is needed for cleaning the air.

Figure 10:
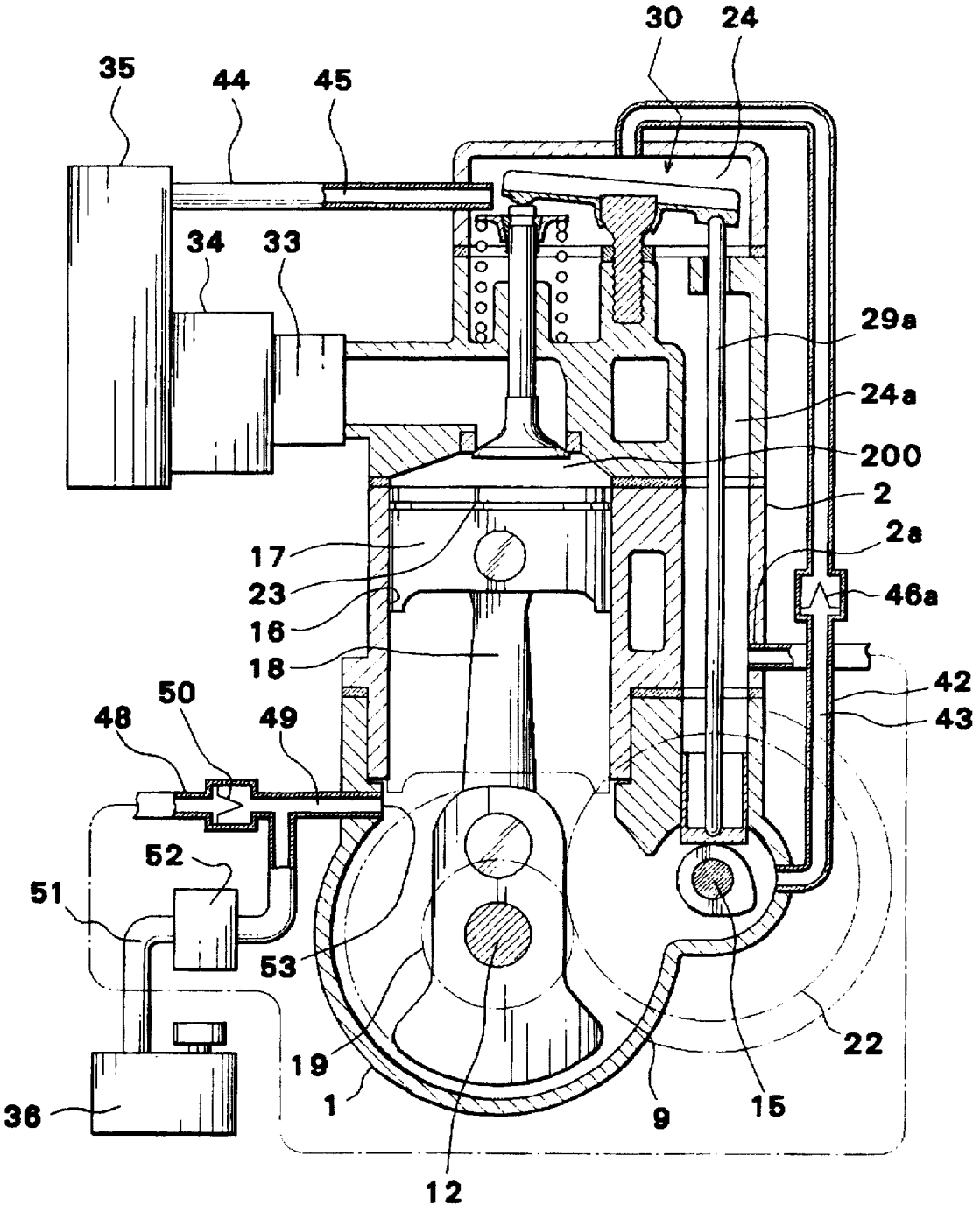
FIG. 10 is a longitudinal sectional front view of the four-stroke-cycle engine in a second modification of the second embodiment.

A second modification of the second embodiment according to the present invention will be explained with reference to FIG. 10. In the present modification, the other end of the pipe 48 having the gas passage 49, the inside of which has been explained in FIG. 9, is connected to a connecting hole 2*a* formed in the cylinder block 2, to thereby connect the crank chamber 9, by the gas passage 49, to the push rod space 24*a* which is a part of the valve mechanism housing space 24 and in which the push rod 29*a* is inserted. That is, the valve mechanism housing space 24 communicates with the inlet of the gas passage 49 through the push rod space 24*a*.

In the above-described constitution, the valve 50 is opened at the time when a negative pressure is built up in the crank chamber 9 with the rise of the piston 17, thereby allowing the flow of the blowby led into the valve mechanism housing space 24 together with the oil from the push rod space 24*a* into the crank chamber 9 via the gas passage 49, thus lubricating each part in the crank chamber 9.

Since the blowby gas led into the valve mechanism housing space 24 is used as a gas flowing into the crank chamber 9, the amount of the blowby gases to be returned to the air cleaner 35 via the interior of the blowby gas return passage 45, thus improving the air intake efficiency of air to be used for producing a mixture and accordingly improving the output of the four-stroke-cycle engine.

Figure 11:
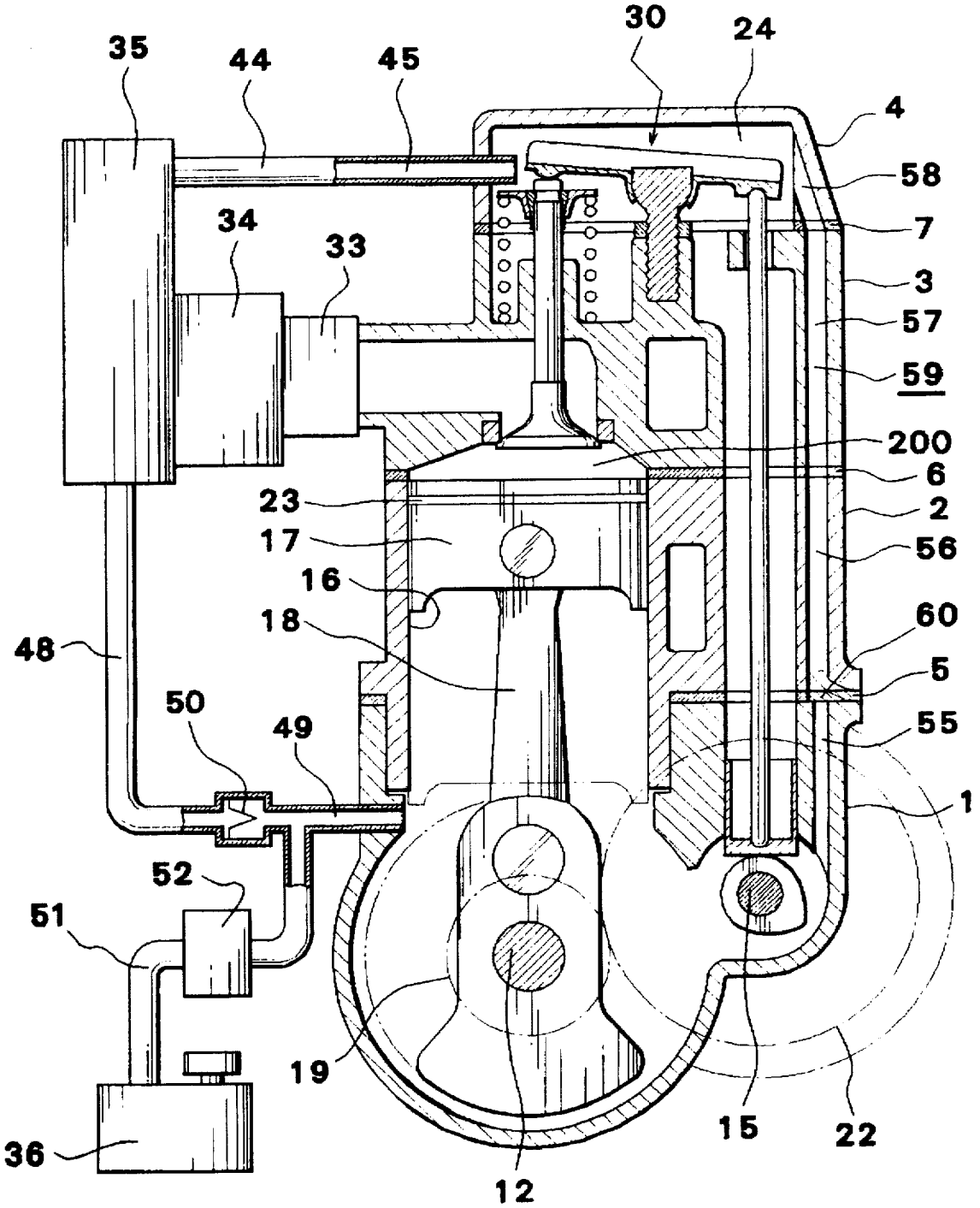
FIG. 11 is a longitudinal sectional front view of the four-stroke-cycle engine in a third modification of the second embodiment.

A third modification concerning the second embodiment according to the present invention will be explained with reference to FIG. 11. In this modification, a blowby gas passage 59 is formed by connecting a first passage 55 formed in the crank case 1, a second passage 56 formed in the cylinder block 2, a third passage 57 formed in the cylinder head 3, and a fourth passage 58 formed in the rocker arm cover 4. Furthermore, a valve 60 is formed integrally with the first gasket 5 interposed between the crank case 1 and the cylinder block 2. Therefore, similarly to the example shown in FIG. 5, no pipe is needed for forming the blowby gas passage and further, no separate valve is needed for checking the back flow of the blowby gases, thereby enabling decreasing the number of parts and accordingly lowering the cost.

Figure 13:
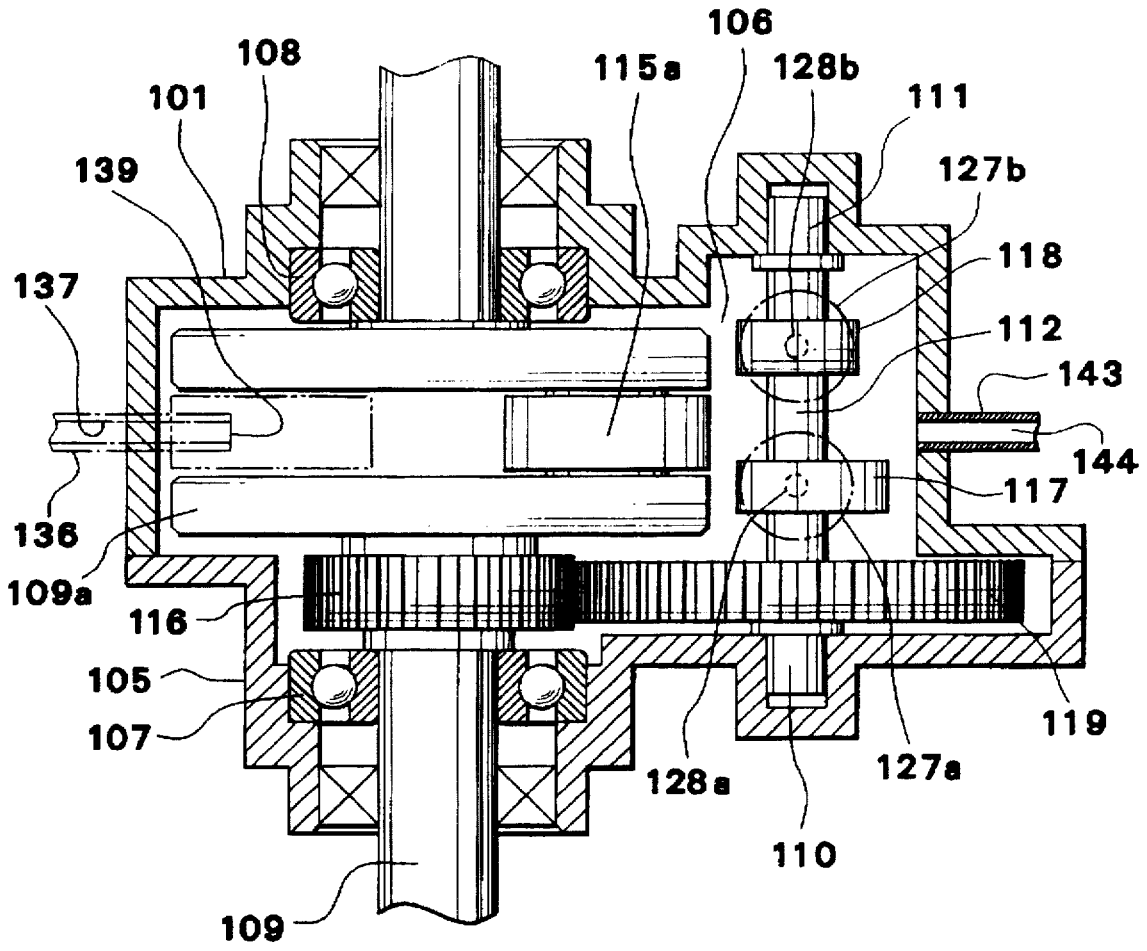
FIG. 13 is a sectional view taken along the line A—A in FIG. 12.
Figure 14:
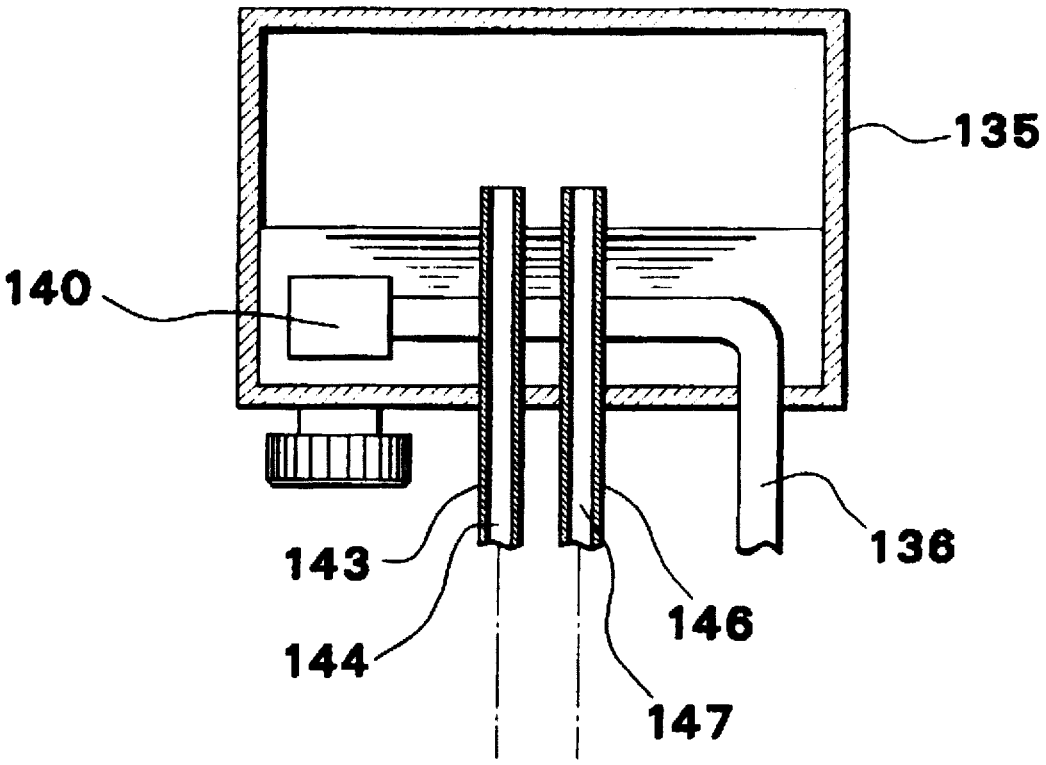
FIG. 14 is a longitudinal sectional front view of an oil tank with the four-stroke-cycle engine positioned upside down.

A third embodiment according to the present invention will be explained with reference to FIGS. 12, 13 and 14. The present embodiment differs in the constitution of the oil removing means from the first and second embodiments.

Figure 12:
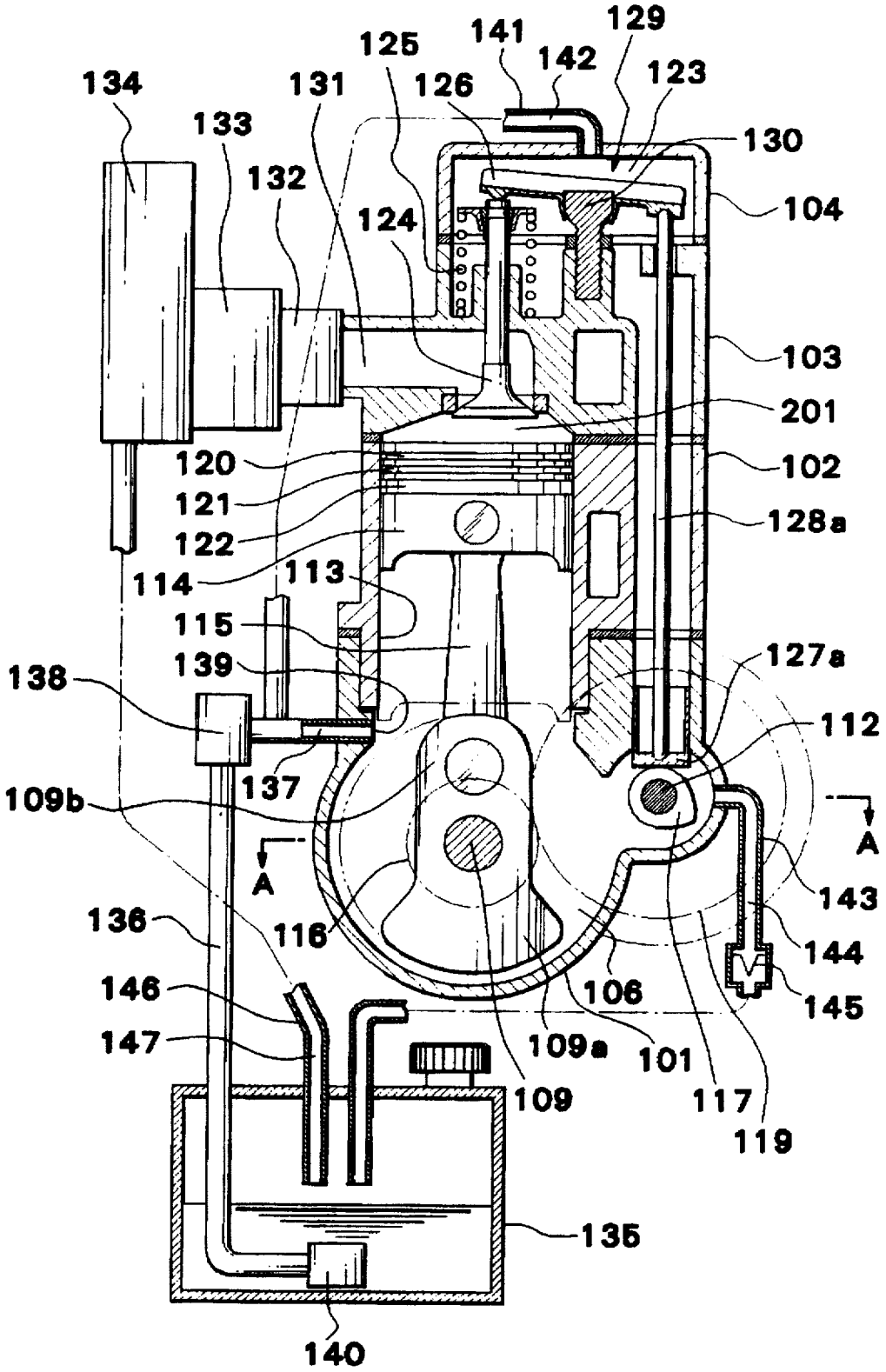
FIG. 12 is a longitudinal sectional front view of the four-stroke-cycle engine in a third embodiment according to the present invention.

FIG. 12 shows the general construction of the four-stroke-cycle engine to be mounted and used on a portable work machine. In this engine a cylinder block 102 is mounted on the top of the crank case 101; a cylinder head 103 is mounted on the top of the cylinder block 102; and a rocker arm cover 104 is mounted on the top of the cylinder head 103. On the side surface of the crank case 101 is mounted a crank case cover 105 as shown in FIG. 13; and a crank chamber 105 is surroundedly formed of the crank case 101 and the crank case cover 105.

In the crank chamber 106 are rotatably housed a crankshaft 109 which is a moving part supported on bearings 107 and 108 at both end sections, and a camshaft 112 supported on bearings 110 and 111 at both end sections. To the crankshaft 109 a piston 114 which reciprocates in the cylinder 113 formed in the cylinder block 102 is connected through a connecting rod 115 which is a moving part, and further, a crank gear 116 which is a moving part is secured. On the camshaft 112 are secured an intake cam 117 and an exhaust cam 118. Furthermore, a cam gear 119 in mesh with the crank gear 116 is secured. On the outer periphery of the piston 114 two compression rings 120 and 121 and one oil ring 122 are mounted.

The space covered with the rocker arm cover 104 in the upper part of the cylinder head 103 is a valve mechanism housing space 123, in which is housed a valve mechanism 129 which comprises a spring 125 pressing an intake valve 124 and an exhaust valve, not shown, mounted in the cylinder head 103 toward a closing direction, a rocker arm 126 pressing the intake valve 124 and the exhaust valve toward an opening direction, and push rods 128*a* and 128*b* held in contact at one end with the rocker arm 126 and at the other end with the intake cam 117 and the exhaust cam 118 through tappets 127*a* and 127*b*. The rocker arm 126 is rockably mounted by an adjusting screw 130 in the upper part of the cylinder head 103. In the cylinder head 103 are formed an intake port 131 for feeding the air-fuel mixture to the combustion chamber 201 in the cylinder 113 and an exhaust port, not shown, through which burned gases are exhausted from inside the combustion chamber 201. To the intake port 131 a carburetor 133 is connected via an insulator 132. To this carburetor 133 an air cleaner 134 is connected.

Next, an oil supply means for applying fine particles of oil to moving parts in the crank chamber 106 for lubrication of the moving parts and the valve mechanism 129 will be explained. There is provided an oil tank 135 for holding the oil, and this oil tank 135 and the crank chamber 106 are connected by an oil pipe 136, so that the interior of this oil pipe 136 will serve as an oil passage 137. On the way of the oil pipe 136 there is provided an oil pump 138 which is an oil supply device for supplying the oil from the oil tank 135 into the crank chamber 106. An opening section 139 of the oil passage 137 which is open in the crank chamber 106 is so formed as to come to a position above either one of the piston 114 and such moving parts as the crankshaft 109, the connecting rod 115, and the crank gear 116 disposed inside the crank chamber 106 in whichever direction the four-stroke-cycle engine is tilted. Therefore, the oil supply means for supplying the fine oil particles to the moving parts in the crank chamber 106 is constituted as a means for striking the oil on the moving parts in the crank chamber 106, to thereby form and apply fine particles of oil to these moving parts.

In one end of the oil pipe 136 disposed in the oil tank 135 a filter 140 is mounted. Also the valve mechanism housing space 123 is connected by an oil pipe 141 to the halfway point of the oil pipe 136. The interior of this oil pipe 141 serves as an oil passage 142. Here, in the oil tank 135 and a fuel tank, not illustrated, similarly to the fuel tank of the two-stroke-cycle engine used on a conventional portable work machine, the forward ends of the oil pipe 136 and the fuel pipe move downward as shown in FIG. 14 when the four-stroke-cycle engine is inclined, so that the oil and fuel can be supplied at all times.

The oil removing means for removing the oil that has been supplied into the crank chamber 106 will be explained. The oil removing means is constituted as a means for returning the oil from the crank chamber 106 to the oil tank 135 with a pressure built up by the reciprocation of the piston 114. In further details, a pipe 143 is connected between the crank chamber 106 and the oil tank 135. The interior of the pipe 143 serves as a blowby gas passage 144 for leading the blowby gases produced in the crank chamber 106 into the oil tank 135. The blowby gas passage 144 communicates with the crank chamber 106 at a place close to the camshaft 112. In the blowby gas passage 144, there is provided a valve 145 which opens and closes with a pressure change in the crank chamber 106 in accordance with the sliding motion of the piston 114. The valve 145 is designed to open only when the pressure in the crank chamber 106 has increased high. Therefore, the oil removing means is of such a construction that when the pressure in the crank chamber 106 has increased high, the oil together with the blowby returns from the crank chamber 106 to the oil tank 135 via the blowby gas passage 144.

Between the oil tank 135 and the air cleaner 124 a pipe 146 is connected. The interior of the pipe 146 serves as a blowby gas return passage 147, through which the blowby led into the oil tank 135 is drawn into the air cleaner 134. The amount of oil to be fed to the oil tank 135 is set to 50 percent or less of the tank capacity, and the forward end portion of the pipe 146 located in the oil tank 135 is disposed approximately at the central part of the oil tank 135, in order to prevent the flow of the oil from the oil tank 135 into the blowby gas return passage 147 when the oil tank 135 is tilted in any direction. The forward end portion of the pipe 143 in the oil tank 135 is also located approximately at the central part of the oil tank 135 for the purpose of restraining oil agitation likely to be caused by the blowby.

During operation of the four-stroke-cycle engine of the above-described constitution, the oil pump 138 is driven to supply the oil from the oil tank 135 into the crank chamber 106 via the oil passage 137, and also to the valve mechanism housing space 123 via the oil passage 142, thereby lubricating each part in the crank chamber 106 and the valve mechanism 129 in the valve mechanism housing space 123. The amount of oil supplied is of the order of 10 cc/h in an engine of 20 to 30 cc displacement. Also the amount of oil to be supplied into the valve mechanism housing space 123 is very little as compared with the amount of oil to be supplied into the crank chamber 106.

The oil supplied into the crank chamber 106 drops from the opening section 139. This opening section 139 is so formed as to come to a position above either one of the piston 114 and moving parts such as the crankshaft 109, the connecting rod 115, and the crank gear 116 when the four-stroke-cycle engine is tilted in any direction. Therefore the oil that has dropped from the opening section 139 strikes on a crank weight **109*a* and a crank arm 109*b* which are parts of the crankshaft 109, the crank gear 116, the large end section 115*a* of the connecting rod 115, and the skirt section of the piston 114, becoming fine particles and scattering. The fine oil particles thus scattering attach on sliding and engaging sections of the parts in the crank chamber 106**, thus lubricating each of these parts.

The oil supplied into the crank chamber 106, after lubricating each part in the crank chamber 106, passes, together with the blowby gases generated in the crank chamber 106, through the blowby gas passage 144 into the oil tank 135, where the oil included in the blowby gases is separated from the blowby gases, being returned into the oil tank 135. At this time, no oil accumulation occurs in the crank chamber 106; and therefore no oil leakage will take place if the four-stroke-cycle engine of the present embodiment is tilted largely. Therefore when the four-stroke-cycle engine is mounted on a portable work machine, the portable work machine is usable in all positions. Moreover, since the oil recovery from the crank chamber 106 is performed by utilizing the blowby gas flow, no oil recovery pump is needed, resulting in a lowered four-stroke-cycle engine price.

The blowby led into the oil tank 135 and separated from oil flows through the blowby gas return passage 147, being drawn into the air cleaner 134. The blowby thus drawn into the air cleaner 134 is mixed with the fuel and then burned in the combustion chamber 201.

Here, the blowby gas passage 144 communicates with the crank chamber 106 at a point close to the camshaft 112; and therefore the blowby flowing from the crank chamber 106 into the blowby gas passage 144 flows around the camshaft 112. Accordingly the oil included in the blowby is applied to the bearings 110 and 111 of the camshaft 112, and to the sliding sections of the cams 117 and 118 fixed on the camshaft 112 and tappets **127*a* and 127*b***.

In the four-stroke-cycle engine of the present embodiment, as previously described, there is no need to throw much oil in the oil pan by means of an oil splasher which is rotated with the crankshaft 109 as in the four-stroke-cycle engine equipped with an oil pan; the rotational resistance of the crankshaft 109 decreases, thereby improving the output of the four-stroke-cycle engine.

Figure 15:
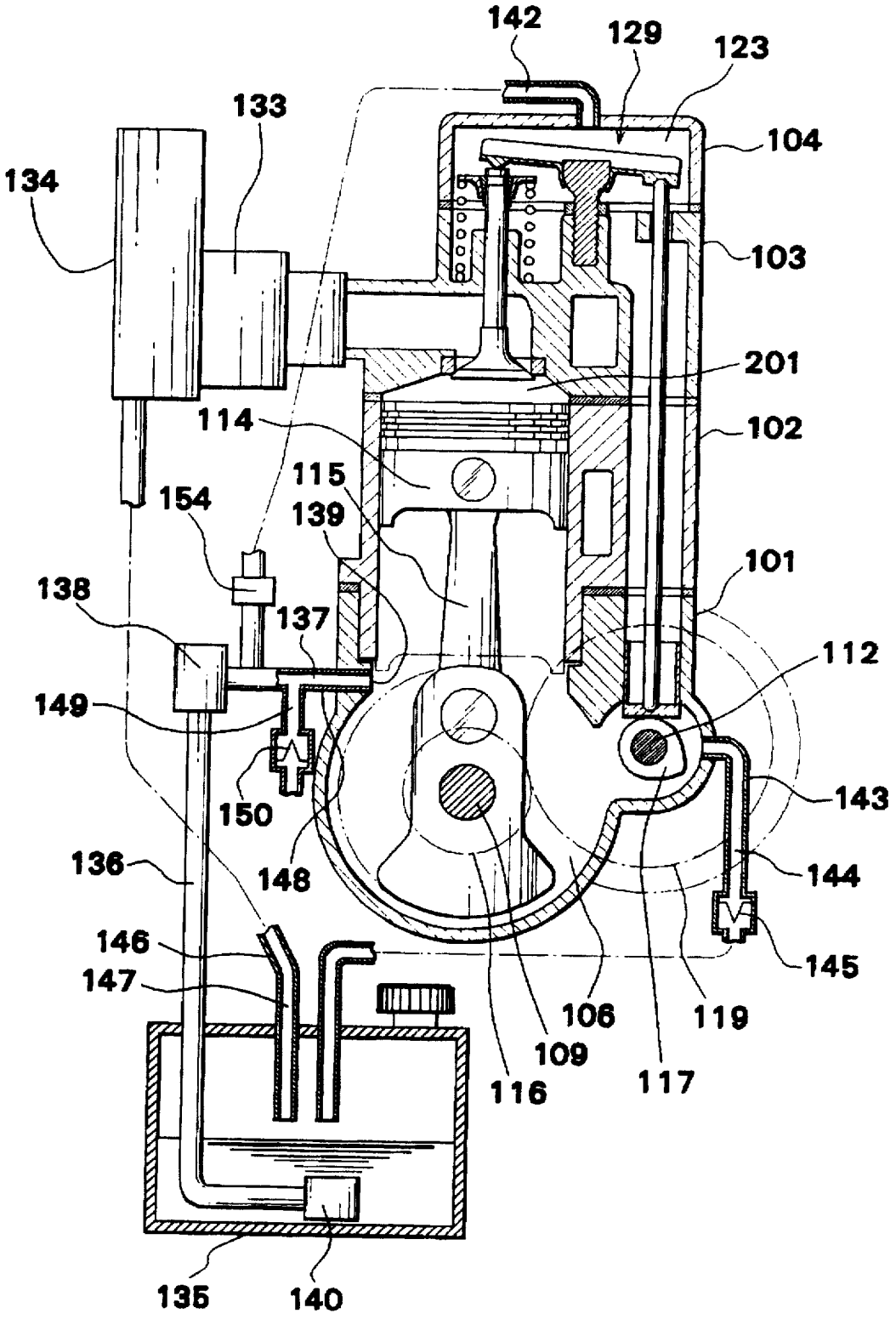
FIG. 15 is a longitudinal sectional front view in a first modification of the third embodiment.

A first modification concerning the third embodiment according to the present invention will be explained with reference to FIG. 15. In the present modification, there is adopted a conceptually similar constitution to the second embodiment as the constitution of the oil supply means which supplies fine particles of oil to the moving parts in the crank chamber 106. That is, the pipe 146 connected between the oil tank 135 and the air cleaner 134 is branched off, and the branched portion is connected to the oil pipe 136 which serves as the oil passage 137. The interior of the pipe 148 branched from the pipe 146 and communicating with the oil pipe 136 serves as the gas passage 149. In this gas passage 149 there is inserted a valve 150 which opens and closes in accordance with a pressure change in the crank chamber 106 with the reciprocation of the piston 114, to thereby allow only the flow of blowby toward the crank chamber 106. In the oil passage 142 provided in the oil pipe 141 connected between the valve mechanism housing space 123 and the oil pipe 136, a check valve 154 is inserted for checking the back flow of the oil from the valve mechanism housing space 123 into the crank chamber 106 when the pressure in the crank chamber 106 has become negative.

In the above-described constitution, during operation of the four-stroke-cycle engine, the oil pump 138 is operated to supply the oil from the oil tank 135 to the section connecting the oil passage 137 with the gas passage 149, and also to the valve mechanism housing space 123 via the oil passage 142. Also, the valve 150 opens and closes according to a pressure change in the crank chamber 106 caused by the reciprocation of the piston 114; and the blowby led into the oil tank 135 flows into the crank chamber 106 via the gas passage 149 and the oil passage 137 at the timing when the piston 114 rises to built up a negative pressure in the crank chamber 106. Then, when the blowby flows into the crank chamber 106, the oil fed into the gas passage 149 is blown into a form of fine particles by the blowby, flowing together with the blowby into the crank chamber 106.

The oil thus blown by the blowby into a form of fine particles hits on the crank weight 109*a*, crank arm 109*b*, connecting rod 115, crank gear 116, and the skirt section of the piston 114, scattering in a further finer mist form to thoroughly lubricate each part in the crank chamber 106.

Figure 16:
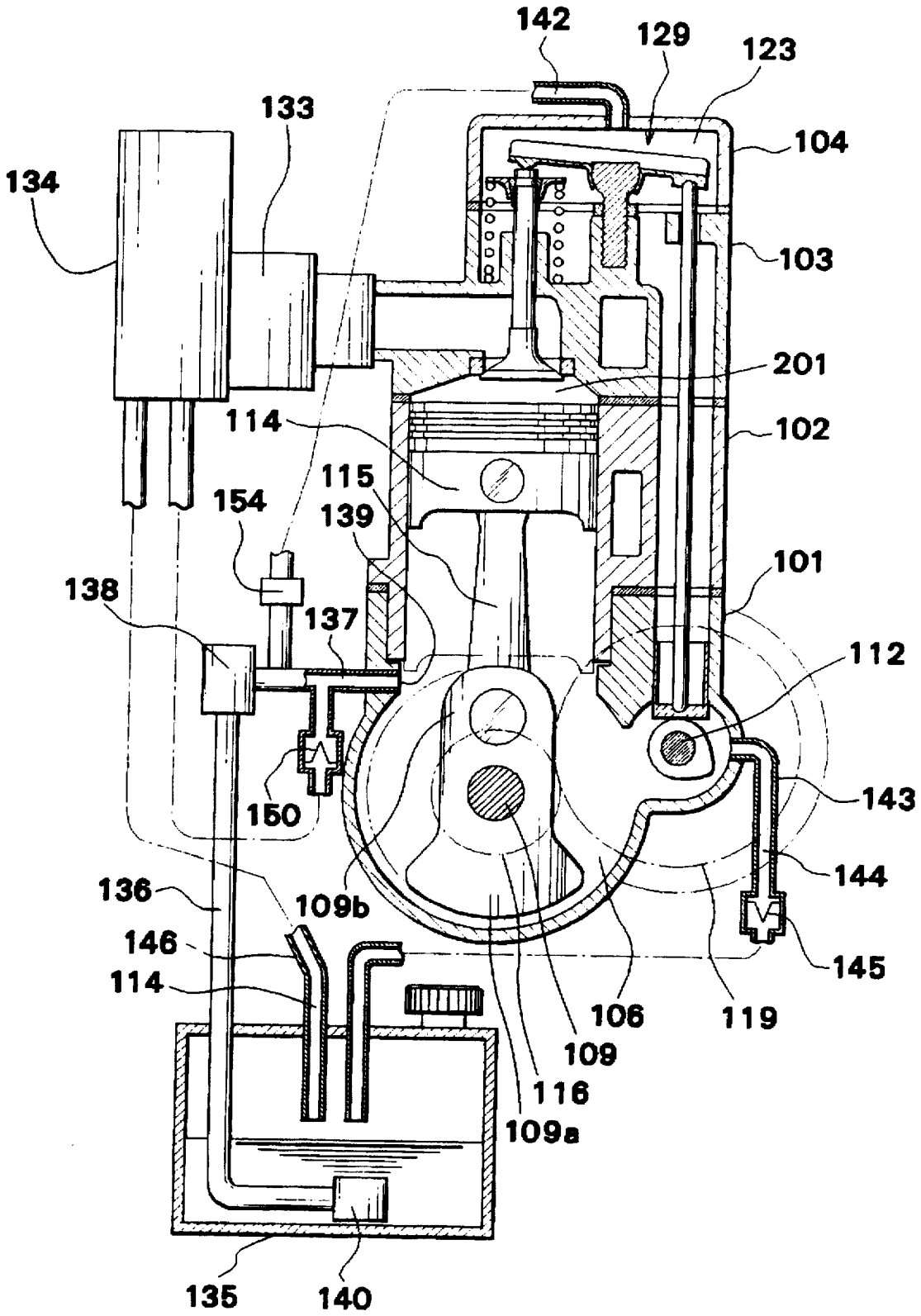
FIG. 16 is a longitudinal sectional front view of a four-stroke-cycle engine showing a second modification of the third embodiment.

A second modification of the third embodiment according to the present invention will be explained with reference to FIG. 16. The present modification is a variation of the first modification shown in FIG. 15. That is, the air cleaner 134 of the carburetor 133 is interposed between the branched point of the pipe 146 connected between the oil tank 135 and the air cleaner 134 and the oil pipe 136 which serves as the oil passage 137. Therefore, the blowby led into the crank chamber 106 when the negative pressure is built up in the crank chamber 106 by the reciprocation of the piston 114 passes once through the air cleaner 134 for filtering impurities such as dusts.

Figure 17:
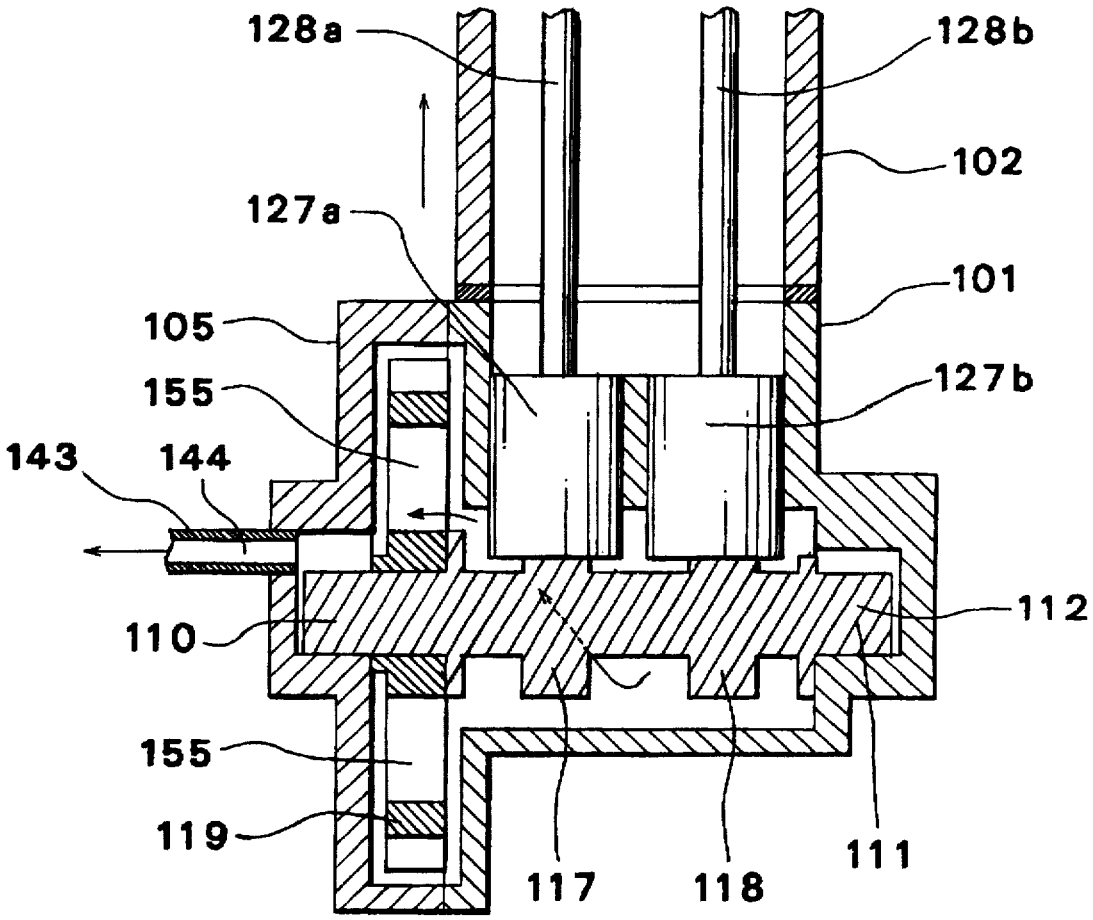
FIG. 17 is a longitudinal sectional side view in a third modification of the third embodiment.

Next, a third modification concerning the third embodiment according to the present invention will be explained with reference to FIG. 17. In the present modification, a through hole 155 is formed in the cam gear 119 to allow blowby passage from one side to the other side of the cam gear 119. Furthermore, one end of the blowby gas passage 144 communicates with a space defined between the inner peripheral surface of the crank chamber 106 and the side face of the cam gear 119. Therefore, the blowby led into the oil tank 135 passes through the through hole 155 and through a narrow space between the side face of the cam gear 119 and the inner peripheral surface of the crank chamber 106, then flowing into the blowby gas passage 144 to thereby insure thorough lubrication to the bearing 110 located behind the cam gear 119 and prevention of seizure and abrasion.

What is claimed is:

1. A lubricating system for lubricating each moving part in a four-stroke-cycle engine, comprising:

an oil tank for holding oil;

an oil passage communicating with said oil tank and a crank chamber of the engine;

an oil supply means for supplying the oil from said oil tank in a form of fine particles to the moving parts in the crank chamber via said oil passage; said oil supply means being constituted of at least one of means for striking the oil of a liquid form on the moving parts in the crank chamber to make fine particles of the oil and for mixing the oil of a liquid form with a gas flowing into the crank chamber to produce fine particles of the oil; and an oil removing means for removing the fine particles of oil supplied to the moving parts in the crank chamber without forming oil accumulation in the crank chamber; said oil removing means being constituted of at least one of means for leading the oil supplied to the moving parts up to a combustion chamber through a piston of the engine, and for returning the oil to said oil tank with a pressure produced by the reciprocation of the piston.

2. A lubricating system as recited in claim 1, wherein, as said oil supply means, there is selected a means for supplying the oil in a form of fine particles by striking the oil of a liquid form on the moving parts; said means comprising:

an oil supply device for supplying the oil from said oil tank to the crank chamber via said oil passage; and an opening section of said oil passage communicating with the crank chamber in a position above the moving parts.

3. A lubricating system as recited in claim 2, wherein said opening section of said oil passage is disposed in such a position that the oil freely dropping from said opening section will hit on a crankshaft (the moving part) of the engine when the engine is tilted at least from 0° to 90°.

4. A lubricating system as recited in claim 2, wherein said opening section of said oil passage is disposed in a position where the oil freely dropping from said opening suction hits on a crank gear (the moving part) secured on the engine crankshaft.

5. A lubricating system as recited in claim 2, wherein said opening section of said oil passage is disposed in a position where the oil freely dropping from said opening section hits on the piston (the moving part) when the engine is tilted over 90°.

6. A lubricating system as recited in claim 1, wherein, as said oil supply means, there is selected a means for mixing the oil of a liquid form with gas flowing into the crank chamber to make fine particles of oil; said means comprising:

a gas passage communicating with said oil passage;

a valve mounted in said gas passage which allows only a stream of the gas flowing toward the crank chamber, of streams of gas generated in said gas passage in accordance with a pressure change in the crank chamber with the reciprocation of the piston; and an oil supply device for supplying the oil from said oil tank to a connecting section between said oil passage and said gas passage via said oil passage.

7. A lubricating system as recited in claim 6, wherein an air filter is mounted at the inlet of said gas passage.

8. A lubricating system as recited in claim 7, wherein, as said air filter, an air cleaner provided with the engine carburetor is used.

9. A lubricating system as recited in claim 6, further comprising a blowby gas passage connected to a valve mechanism housing space of the engine and the crank chamber, said valve mechanism housing space communicating with the inlet of said gas passage, wherein the blowby generated in the crank chamber is led to said valve mechanism housing space via said blowby gas passage and further to the inlet of said gas passage from said valve mechanism housing space.

10. A lubricating system as recited in claim 6, wherein said opening section of said oil passage communicating with the crank chamber is located above the moving parts.

11. A lubricating system as recited in claim 1, wherein, as said oil removing means, there is selected a means for leading the oil fed to the moving parts up to the combustion chamber through the piston; said means being constituted by mounting only a compression ring on the outer periphery of the piston.

12. A lubricating system as recited in claim 1, wherein, as said oil removing means, there is selected a means for returning the oil to said oil tank with a pressure generated by the reciprocation of the piston; said means being constituted of a blowby gas passage which is connected to the crank chamber and said oil tank, for leading the blowby gas generated in the crank chamber together with fine particles of oil into said oil tank.

13. A lubricating system as recited in claim 12, wherein a camshaft used in the engine valve mechanism is applied to the engine of overhead valve type disposed in the crank chamber, and a portion connecting the crank chamber with said blowby gas passage is disposed in the vicinity of said camshaft.

14. A lubricating system as recited in claim 13, wherein said cam gear has a through hole which the blowby gas passes through.

15. A lubricating system as recited in claim 12, further comprising a blowby gas return passage connected to the inlet side of said air cleaner of the engine carburetor and said oil tank; said blowby gas return passage leading the blowby led into said oil tank to the engine combustion chamber.

16. A lubricating system as recited in claim 15, wherein there is provided said oil supply means stated in claim 6, and the inlet of said gas passage is connected to said blowby gas return passage, wherein the blowby gas led into said oil tank is supplied to a connecting section between said gas passage and said oil passage via said blowby gas return passage and said gas passage so as to form fine particles of the oil supplied via said oil passage.

17. A lubricating system as recited in claim 1, further comprising a blowby gas passage connected to the engine valve mechanism housing space and the crank chamber.

18. A lubricating system as recited in claim 17, wherein said lubricating system is applied to an overhead valve type engine with the camshaft of the engine valve mechanism disposed in said crank case, and a connecting section between the crank chamber and said blowby gas passage is disposed in the vicinity of the camshaft.

19. A lubricating system as recited in claim 18, wherein said cam gear has a through hole which the blowby gas passes through.

20. A lubricating system as recited in claim 17, further comprising a blowby gas return passage connected to the inlet side of said air cleaner of the engine carburetor and said valve mechanism housing space, said blowby gas return passage leads the blowby gas led to said valve mechanism housing space to the engine combustion chamber.

21. A lubricating system as recited in claim 17, wherein said blowby gas passage is formed by connecting a first passage formed in the crank case, a second passage formed in the cylinder block, and a third passage formed in the cylinder head.

22. A lubricating system as recited in claim 21, wherein a valve located within said blowby gas passage to permit only the flow of blowby gas from the crank chamber toward said valve mechanism housing space is formed integrally with at least one of a first gasket interposed between the crank case and the cylinder block, a second gasket interposed between the cylinder block and the cylinder head, and a third gasket interposed between the cylinder head and a rocker arm cover covering the engine valve mechanism.

23. A lubricating system as recited in claim 17, wherein said lubricating system is applied to the overhead valve type engine with the camshaft of the engine valve mechanism disposed in said crank case; said blowby gas passage being formed by connecting a push rod space for housing a push rod to the crank chamber.

* * * * *